United States Patent [19]

Kobayashi et al.

[11] Patent Number: 4,766,431

[45] Date of Patent: Aug. 23, 1988

[54] PERIPHERAL APPARATUS FOR IMAGE MEMORIES

[75] Inventors: Yoshiki Kobayashi; Hiroshi Takenaga; Takeshi Katoh, all of Hitachi, Japan

[73] Assignee: Hitachi, Ltd., Tokyo, Japan

[21] Appl. No.: 772,695

[22] Filed: Sep. 5, 1985

[30] Foreign Application Priority Data

Sep. 5, 1984 [JP] Japan ..... 59-184658

[51] Int. Cl.[4] ..... G09G 1/16

[52] U.S. Cl. ..... 340/799; 340/723; 340/744; 340/789

[58] Field of Search ..... 340/724, 726, 789, 799, 340/800, 801, 792, 723, 744, 747

[56] References Cited

U.S. PATENT DOCUMENTS

| | | | |
|---|---|---|---|
| 4,303,986 | 12/1981 | Lans | 340/798 |
| 4,396,295 | 8/1983 | Ishikawa | 340/792 |
| 4,445,114 | 4/1984 | Stubben | 340/726 |
| 4,562,435 | 12/1985 | McDonongh et al. | 340/798 |
| 4,575,717 | 3/1986 | Fedele | 340/799 |
| 4,580,135 | 4/1986 | Kummer et al. | 340/799 |

OTHER PUBLICATIONS

"Color-Graphics Controller Chip Set Reduces Parts Count, Incorporates Microcomputer", Electronics, Apr. 19, 1984, pp. 166–168.

*Primary Examiner*—Gerald L. Brigance
*Assistant Examiner*—Jeffery A. Brier
*Attorney, Agent, or Firm*—Antonelli, Terry & Wands

[57] ABSTRACT

A peripheral apparatus for image memories can communicate image data with a memory assembly having n blocks of a standard-type DRAM, whether the DRAM is for a page mode or for a nibble mode type operation. The apparatus comprises a read data processing unit sending the data of a selected one among n pixels read from the DRAM blocks in parallel to an external image/graphics processor, a write data processing unit modifying the image data taken thereinto and writing the modified data into the DRAM blocks, a feedback data processing unit writing the image data now on displaying into the DRAM blocks after a desired processing again, a display data processing unit sending the data read from the DRAM blocks to a monitor for display and to the external processor for the feedback processing, and a control unit furnishing control signals to those processing units in response to instructions from the external processer.

21 Claims, 11 Drawing Sheets

(DYNAMIC RANDOM ACCESS MEMORY)

IMAGE MEMORY
BADR
ADR (SINGLE)
O, △ PIXEL
MFUN
IDATA
MODIFI-CATION ALU
IMAGE MEMORY
CDATA
ADR
READ-OUT IMAGE DATA FOR MODIFICATION (BLOCK)
MFUN
IDATA
MODIFI-CATION ALU
IMAGE MEMORY
ADR
CDATA (COPY)
MFUN
4PIXELS
MODIFI-CATION ALU
BARREL SHIFTER
READ-OUT IMAGE DATA FOR COPY

PERIPHERAL APPARATUS FOR IMAGE MEMORIES

BACKGROUND OF THE INVENTION

1. Field of the Invention

The present invention relates to a large-scale-integration circuit apparatus (LSI) for an image and/or graphics processing system, and more particularly to a peripheral LSI for image memories suitable for using standard-type random access memories which are broadly used.

2. Description of the Related Art

Image and/or graphics processing systems mostly use dynamic type random access memories (DRAM) which have made a remarkable progress in higher integration density to satisfy the demand for image memories having a greater capacity. The following are main requirements for the image memory;

(1) to be capable of reading out data for display on an image monitor, and (2) to allow an image and/or graphics processer access (read/write).

Usually, a memory cycle time of a DRAM is about 300 nano-seconds. When a DRAM is used for the image memory, the operational speed of the image memory becomes around 3 megapixels per second. On the other hand, the display speed in the image monitor is 6 to 100 megapixels per second. Therefore, a plurality of DRAMs in which data for pixels are stored are operated in parallel in order to cope with the difference in the operational speed. For the purpose of this parallel operation of plural DRAMs, a large number of peripheral circuits have been necessary according to conventional practice.

As an LSI for this image memory peripheral circuit, a graphics LSI which can designate one of a plurality of pixels being processed in parallel and can read out the image data of the pixel 64 an external processer or write it into the image memory, is described in the article entitled "Color-graphics controller chip set reduces parts count, incorporates microcomputer" in Electronics/Apr. 19 (1984), p.p. 166–168.

However, the known image memory peripheral LSI does not include the following functions:

(1) a nibble or page mode access, whereby DRAM is capable of operating at a high speed;

(2) a real time data processing, in which a processing of data read out from the image memory, such as a density conversion of pixel data, a calculation between images, a convolution and the like, is executed at the same speed as the display and a processed data is written into the image memory at the same speed again, and/or in which an image data taken by a television camera is written into the image memory at the high speed (the former is especially called a feedback processing, hereinafter);

(3) a modification-write operation, in which a modification processing, such as logical and/or arithmetic operation, is carried out between an image data existing in the image memory and an image data to the written afresh and a modified data is written into the image memory again;

(4) a block-write operation for high speed processing, in which an image data of plural pixels is written into the image memory in parallel;

(5) an arbitrary region processing, in which the data of pixels can be processed pixel by pixel without depending upon the delimitation in the parallel read/-write operation of the memories in a case of the feedback processing or the movement of the image (scroll); and (6) a smooth scroll processing in a transverse direction in image display.

SUMMARY OF THE INVENTION

An object of the present invention is to provide a peripheral apparatus for image memories which can constitute a high performance, high function image memory having the functions enumerated above in combination with standard-type random access memories which are broadly used.

The peripheral apparatus for image memories in accordance with the present invention is characterized in that it supports the n pixels parallel access to the random access memories, whether they are of page mode or nibble mode, effects data processing capable of simultaneously processing the image data of $n \times m$ pixels (m: number of repetition times per one access operation), and in that it is equipped with a shift function for the read/write of image data to make it possible to execute the given processing on the image data existing in an arbitrary region within the image memory. Further, these processing functions are set in a control unit provided in the peripheral apparatus in order to attain programmable change-over.

DESCRIPTION OF THE PREFERRED EMBODIMENT

Hereinafter, the description will be made of a peripheral LSI for an image memory according to a preferred embodiment of the present invention, with reference to accompanying drawings.

1. Outline of System

Figure 1:
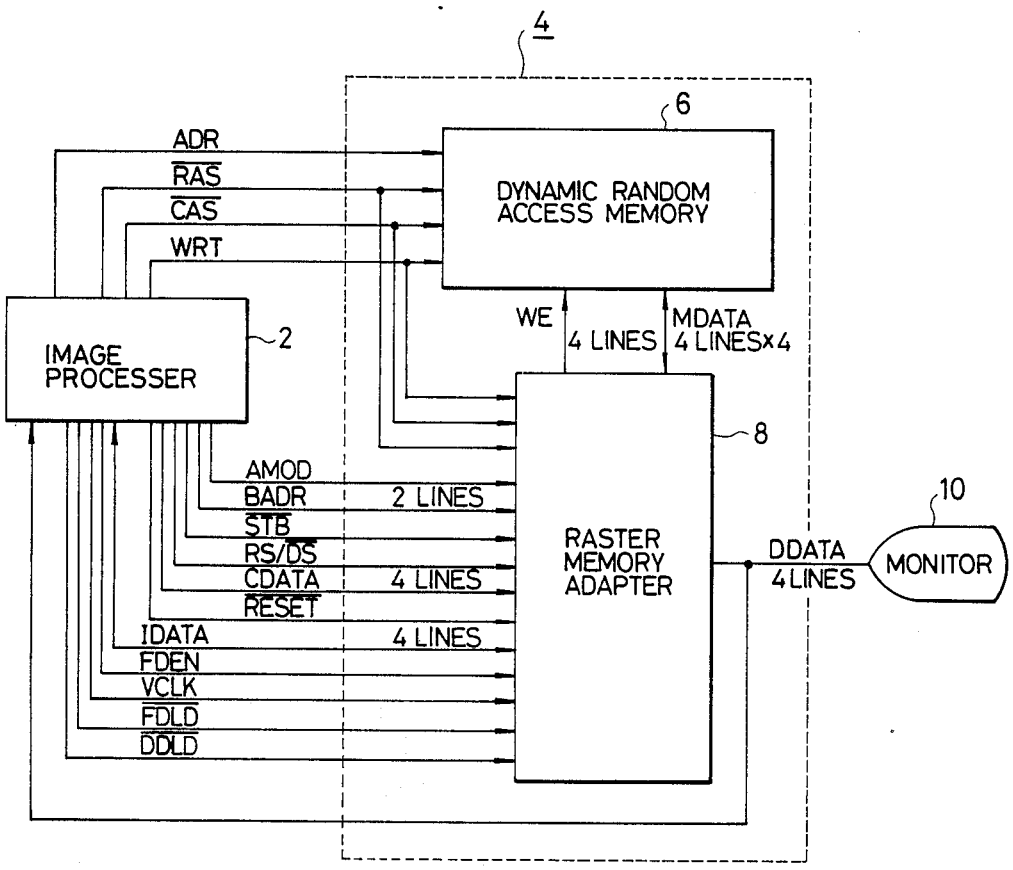
FIG. 1 shows a view of a total structure of an image and/or graphics processing system to which the present invention is applied.

Referring to FIG. 1, an image and/or graphics system has an image processer 2 for image and/or graphics processing, an image memory 4 and a display monitor 10. The image memory 4 comprises DRAM 6 and its peripheral LSI 8. The latter to which the present invention is applied is called a raster memory adapter (RMA), hereinafter. The following description will deal with the image memory 4 consisting of DRAM 6 which has the data quantity of 4 bits per pixel and in which four pixels are accessible in parallel with one another and RMA 8 which supports such DRAM 6.

The image processer 2 conducts graphics processing such as depictions of straight lines, circles, characters and the like and image processing such as movement, rotation, enlargement, smoothening, contour emphasis, fast fourier transform (FFT) and the like, of the image. The image processer 2 may be constituted by a microcomputer so long as it can read and write with respect to the image memory 4. If higher performance is required, it may consist of a processer having a specific construction. In this description, the detail of the image processer 2 is omitted.

2. Dynamic Random Access Memory (DRAM)

Figure 2:
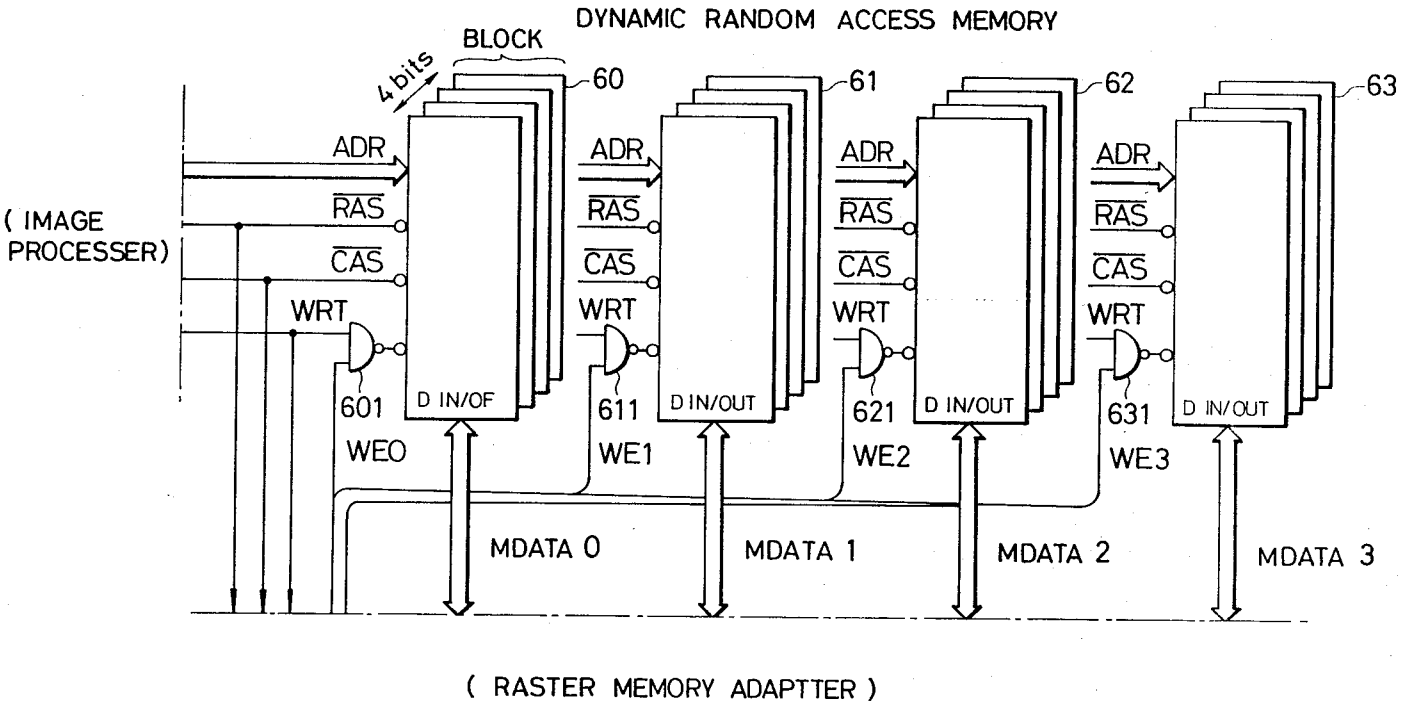
FIG. 2 shows an organization of a dynamic random access memory as an image data storage used in the processing system shown in FIG. 1.

As shown in FIG. 2, a DRAM assembly is composed of four blocks of DRAM 60 to 63, each of which is organized by four memory units, i.e., chips or modules. Accordingly, data read out from one DRAM block, i.e., data for one pixel, is made up of four-bit signals. Each block has an address signal terminal ADR, two strobe signal terminals, i.e., one for a row address strobe $\overline{RAS}$ and the other for a column address strobe $\overline{CAS}$, a write signal terminal WRT, and a data terminal DIN/OUT. Reference characters used here for indication of the terminals also mean signals applied to or derived from the corresponding terminals in the description hereinafter.

The signals ADR, $\overline{RAS}$, $\overline{CAS}$ and WRT are all provided from the image processer 2, and the terminals DIN/OUT of DRAM blocks 60 to 63 are connected with respective buses MDATA 0, 1, 2 and 3, through which a data communication between DRAM 6 and RMA 8 is carried out. It is to be noted here that the signal WRT from the image processer 2 is applied to DRAM blocks through one of the terminals of two-input NAND gates 601 and 631. The other input terminals of the NAND gates are supplied with write enable signals WE 0, 1, 2 and 3, respectively, which are furnished from RMA 8 and therefore will be explained in detail in connection therewith later. Accordingly, the accessible DRAM block is selected by the WE 0, 1, 2 or 3.

Further, the signal WRT determines the mode of access to DRAM blocks. Namely, the signal WRT is a binary signal, and when the signal WRT is maintained at one of two states, the access to DRAM 6 becomes a read operation mode, so that the data stored in a location of DRAM 6 designated by the signal ADR is read out to RMA 8 through the bus MDATA 0, 1, 2 or 3. The timing of reading the data is determined by the signals $\overline{RAS}$ and $\overline{CAS}$. However, when the signal WRT is in the other one of the binary states, the access to DRAM 6 becomes a write operation mode. In this access mode, the data sent through the bus MDATA 0, 1, 2 or 3 is written into DRAM 6 selected by the signal WE 0, 1, 2 or 3 at a location designated by the signal ADR.

As is understood from a memory organization shown in FIG. 2 and the description mentioned above, DRAM 6 used in this embodiment is a standard one. Therefore, the further description about DRAM will be omitted.

3. Raster Memory Adapter (RMA: Peripheral LSI)

Figure 3:
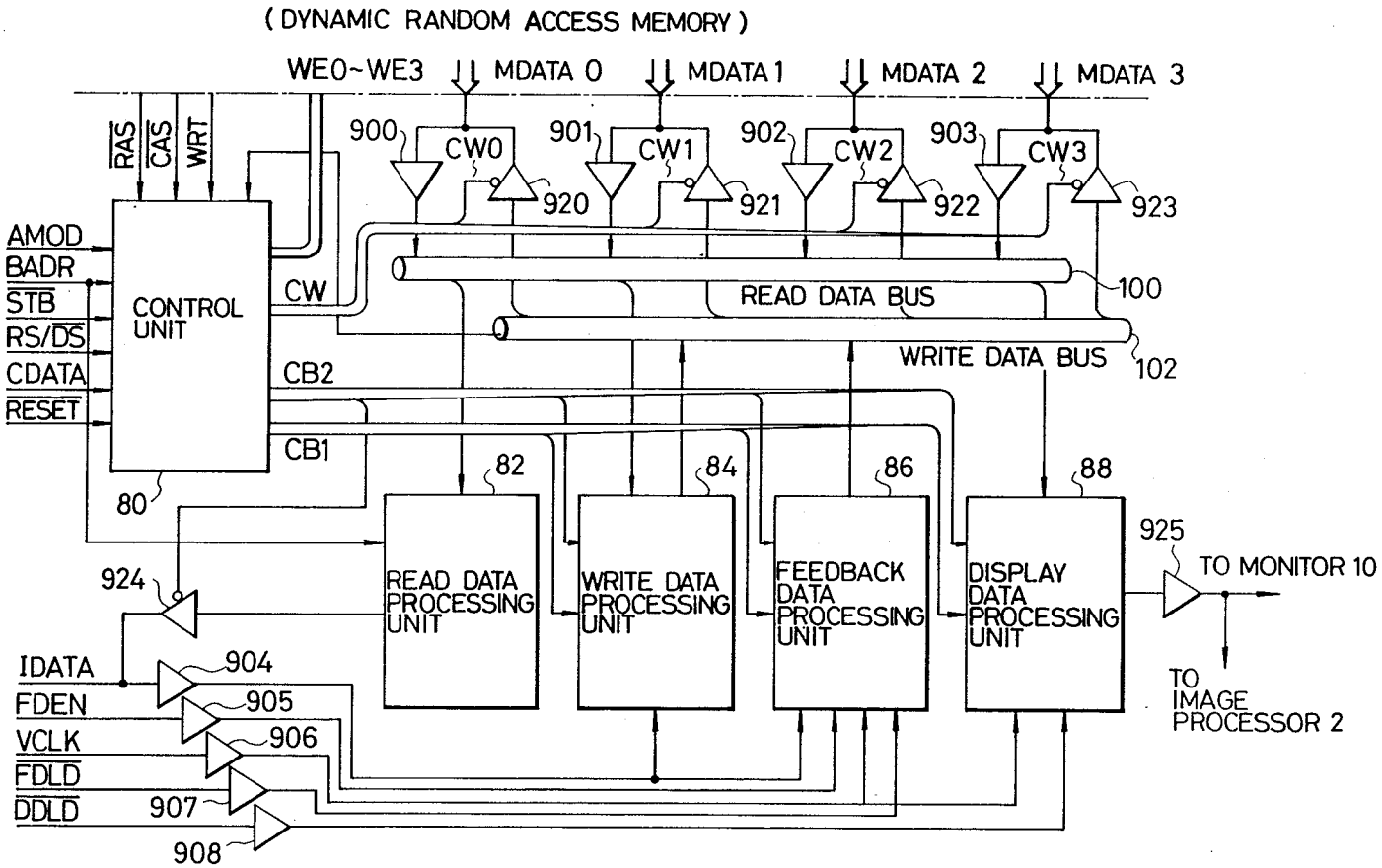
FIG. 3 is a structural view of a peripheral apparatus according to an embodiment of the present invention.

As has been already described, RMA 8 supports four DRAM blocks 60 to 63 and consists of a 48-pin LSI having 45 signal lines tabulated in a signal line table of Table 1. As is shown in FIG. 3, RMA 8 has a control unit 80, a read data processing unit 82, a write data processing unit 84, a feedback data processing unit 86, a display data processing unit 88, and input buffers 900 to 908 and output buffers 920 to 925. Further, a read data bus 100 and a write data bus 102 are disposed in RMA 8 for the purpose of reading or writing data from or to DRAM 6, and each has a data width capable of carrying 4 bits/pixel×4 pixels of information.

The display on the display monitor 10 is effected in the following manner. The image data read out from DRAM 6 is taken into the display data processing unit 88 through the buses MDATA 0 to 3, the input buffers 900 to 903 and the internal read data bus 100, where it is serialized for each pixel and then sent to the display monitor 10 through the output buffer 925 as a display image data DDATA.

This display image data DDATA is also fed back to the image processer 2, in which the processing such as the density conversion and the calculation between images is carried out and the processed data can be written into the image memory 4 again. This is the feedback data processing described already. Accordingly, it is also possible that the calculation between the image data taken by a television camera (not shown) and the image data read out from the image memory 4 is conducted and the calculated data is written into the image memory 4. This processing is executed by means such that the feedback image data is taken into the feedback data processing unit 86 through a bus IDATA and the input buffer 904 and is written into DRAM 6 through the internal write data bus 102, the output buffers 920 to 923 and the bus MDATA 0, 1, 2 or 3.

TABLE 1

Signal Line Table

| Reference of Signal line | Number of Line | Signal carried by the signal line/lines |
|---|---|---|
| MDATA 0 to 3 | 16 | image data communicated with DRAM 6 |
| DDATA | 4 | image data for display in the monitor 10 |
| IDATA | 4 | image data communicated with the image processer 2 |
| CDATA | 4 | control data furnished by the image processer 2 |
| WE 0 to 3 | 4 | write enable signal to DRAM 6 |
| RAS | 1 | signals branching off from the signals RAS, CAS and WRT to DRAM 6, respectively |
| CAS | 1 | |
| WRT | 1 | |

TABLE 1-continued

| Signal Line Table | | |
|---|---|---|
| Reference of Signal line | Number of Line | Signal carried by the signal line/lines |
| BADR | 2 | address signal designating one of four DRAM blocks (block address) |
| AMOD | 1 | signal indicating an operation mode of access to DRAM 6 |
| STB | 1 | strobe signal for various internal control registers of the control unit 80 |
| RS/DS | 1 | signal representing data to be set into a register-number register of the control unit 80 |
| RESET | 1 | signal initializing the various internal control registers of the control unit 80 |
| FDEN | 1 | signal representing that a feedback image data is effective |
| VCLK | 1 | clock signal for the display and feedback operations |
| DDLD | 1 | signal for loading a data into a display shift register of the display data processing unit 88 |
| FDLD | 1 | signal for loading a data into a latch of the feedback data processing unit 86 |
| Total | 45 | |

(note:)
reference used for representation of the signal line is also used for indication of the signal carried by the signal line or lines).

3.1 Input/Output Operation between the image processer 2 and the image memory 4:

A read operation of the image processer 2 which reads out the data from the image memory 4 is executed as follows. Namely, referring to FIG. 3, the image data for the pixel read out from DRAM blocks 60 to 63 is selected in the read data processing unit 82 in accordance with the block address signal BADR which represents one of the four pixels read out simultaneously or in parallel, and is transferred to the image processer 2 through the output buffer 924 and the bus IDATA. A write operation is conducted by the write data processing unit 84, which takes the image data from the image processer 2 through the bus IDATA and the input buffer 904, processes the taken-into image data in a predetermined manner, and writes the processed data into DRAM 6 through the internal write data bus 102, the output buffers 920 to 923 and the bus MDATA 0, 1, 2 or 3.

The mode of access to the image memory 4 is determined by an access mode signal AMOD to RMA 6 and its timing by $\overline{RAS}$, $\overline{CAS}$ and WRT. The timing is the same as that of standard DRAM, therefore.

DRAM 6 can be operated in a high speed access mode. The page mode access or the nibble mode access can be made maximum four times by means of RMA 8 according to this embodiment, as shown in the timing chart of FIG. 4. However, ordinary single access and, if necessary, access of twice or thrice can also be made.

In the write operation, an arbitrary one of four DRAM blocks 60 to 63 is selected by the write enable signal WE 0, 1, 2 or 3, and the write operation can be done for the selected DRAM block. This operation holds true of both the page mode and the nibble mode. For the purpose of this selective write operation, as shown in FIG. 2, there are provided, before the WRT terminal of each DRAM block, the NAND gates 601,611,621,631 which permit the application of the signal WRT from the image processer 2 to DRAM blocks 60, 61, 62 or 63 in accordance with the signal WE 0, 1, 2 or 3.

Referring back to FIG. 3, the output of the output buffers 920 to 923 to the bus MDATA 0, 1, 2 and 3 is permitted or inhibited by signals CW 0 to 3 which are in synchronism with the signals WE 0 to 3, respectively. When the output is inhibited, the inhibited output buffer 920, 921,922 or 923 is kept at the high impedance state.

The access operations to the image memory 4 are altogether tabulated in Table 2. As is seen from this table, when the access mode signal AMOD is "0", the read operation for display and the write operation for feedback processing can be executed. At this time, the outputs buffer 924 always keeps the bus IDATA at the high impedance state as viewed from RMA 8. To the contrary, the bus IDATA is maintained at the low impedance state as viewed from the image processer 2. Accordingly, the feedback image data from the image processer 2 can be transferred into RMA 8 through the bus IDATA and the input buffer 904 and written into DRAM 6 from RMA 8 without any interruption at the same speed as the display speed of the data DDATA.

The common use of the bus IDATA for output from and input into RMA 8, as mentioned above, is directed to reduce the number of necessary pins of the LSI chip as RMA 8. If the number of pins may or can be increased, the write data signal pin for feedback is disposed independently of the bus IDATA, and such an arrangement is more versatile. In other words, if only the timing is permissible, the ordinary read/write operation of the image processer 2 can be made even during the feedback processing.

TABLE 2

| Access Modes of Image Memory | | |
|---|---|---|
| Value of AMOD | Mode of Access | Operation |
| 0 | read operation for display | to set data into display-data-read shift registers of the display data processing unit 88; and to bring the bus IDATA into a high impedance state (in which the feedback image data can be input to RMA 8 from the image processer 2 through the bus IDATA). |
| 0 | write operation for feedback processing | to write data for 4 pixels latched in a latch of the feedback data processing unit 86 into DRAM 6, however data of a pixel when FDEN=0 is not written by the signal WE 0, 1, 2 or 3. At this time, the bus IDATA can be driven by the feedback image data. |
| 1 | read operation from DRAM to image processer | to output data of a pixel designated by the signal BADR among 4 pixels read from DRAM 6 onto the bus IDATA. (When CDATA=1, the data for 4 pixels are set into a modification register and, when CDATA=2, into copy registers, of the write data processing unit |

TABLE 2-continued

| Access Modes of Image Memory | | |
|---|---|---|
| Value of AMOD | Mode of Access | Operation |
| | | 84) |
| 1 | write operation into DRAM from image processer | to write data into DRAM 6 in accordance with the signal WMOD (the data can be written for 4 pixels in parallel, and can be also written for only one pixel in accordance with the signals WE 0 to 3). cf FIG. 5. |

3.2 Read/Write Operation:

Ordinary read/write operations can be made when the access mode signal AMOD is "1", as is understood from Table 2. In the case of the read operation, the data of the pixel designated by the block address signal BADR is sent through the bus IDATA to the image processer 2. If the value of the control data CDATA is "1" at this time, the data of all the pixels read out is set into a read data register for modification (i.e., modification register) in the write data processing unit 84, and if it is "2", the data are set to the read data register for copy (i.e., copy register) of the write data processing unit 84. These are the data which are used for the write operation of the next time.

Figures 5A, 5B, 5C:
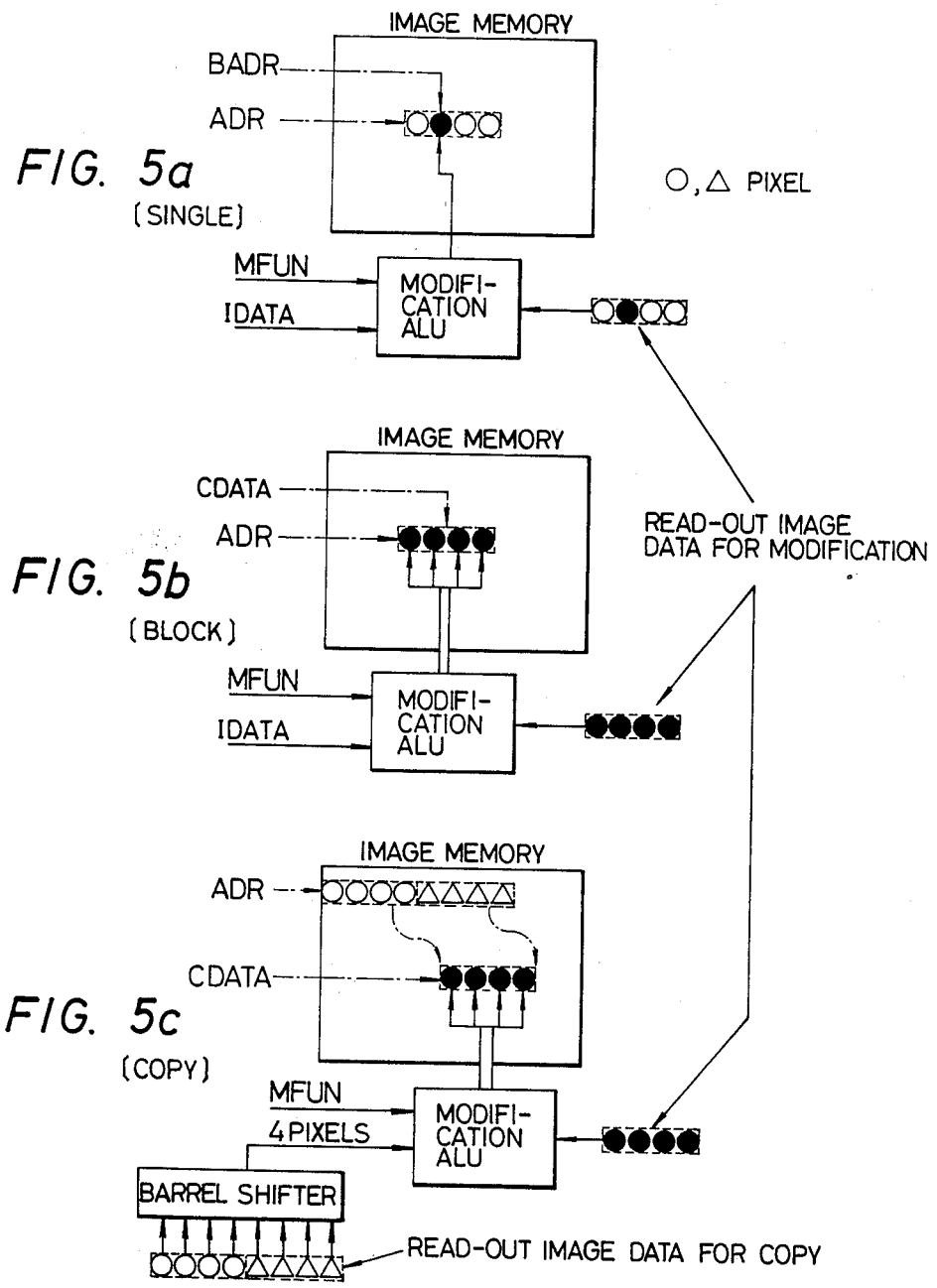
FIGS. 5*a*, 5*b*, and 5*c* are schematic diagrams for the purpose of explaining three modes of the write operation by means of the peripheral apparatus shown in FIG. 3.

Three kinds of the write operations exist in accordance with the content of a write mode register WMOD, one of the control registers in the control unit 80, and the page and nibble mode operations both are possible for each of these write operations. They are shown in FIGS. 5*a* through 5*c*, and will be described below;

(a) Single-mode write operation:

The data IDATA is modified and written into the storage location of the image memory 4 designated by the signals ADR and BADR. This storage location corresponds to a memory cell of DRAM blocks 60 to 63, i.e., one pixel. The modification is made such that the data IDATA and the data read out in advance for modification are calculated in a modification ALU of the write data processing unit 84 in accordance with a signal from the control register MFUN of the control unit 80.

(b) Block-mode write operation:

The data IDATA is modified in the modification ALU and written for all the four pixels. However, the pixels to be written can be designated by the signal CDATA.

(c) Copy-mode write operation:

The term "copy" here means that an image data stored in an arbitrary region of the image memory 4 is transferred to another region. For this copy, the image data is in advance read out into the copy register of the write data processing unit 84, and, after shifted by a predetermined number (three pixels in FIG. 5*c*), the data is written into another region for the four pixels. Also in this case, the write data can be modified in the modification ALU in accordance with the signal from the control register MFUN.

The performance of the image memory 4 can be exhibited to its maximum by combining the page/nibble mode operations of DRAM 6 with the block-mode and copy-mode write operations.

Figure 6:
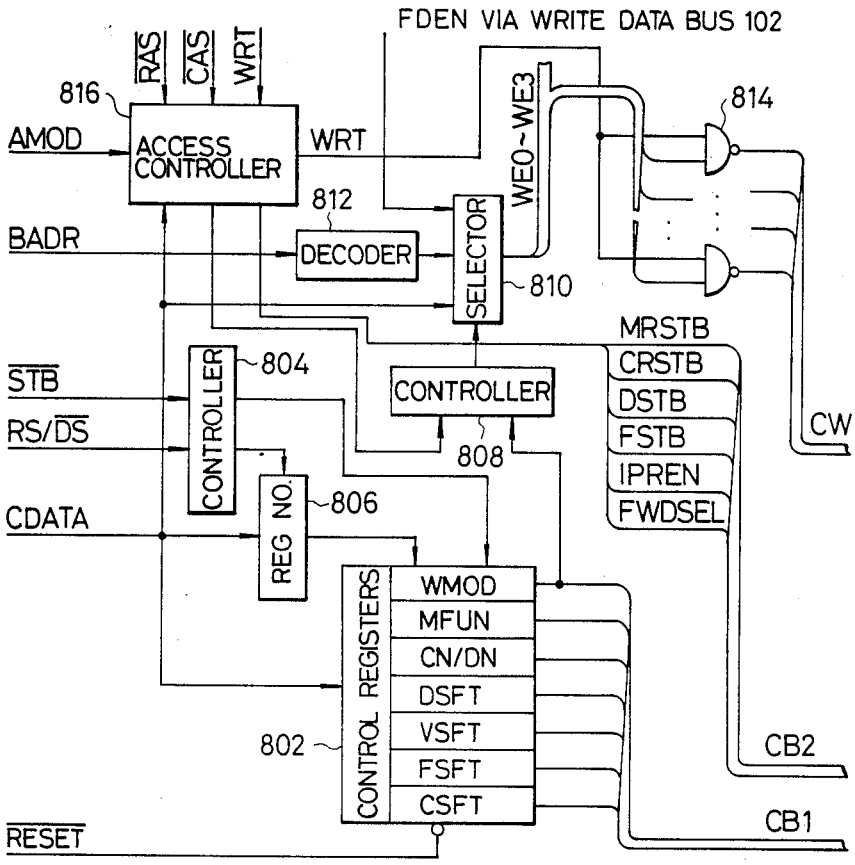
FIG. 6 is a block diagram of a control unit of the peripheral apparatus shown in FIG. 3.

3.3 Control Unit 80:

Next, the detailed description will be made of each unit of RMA 8. Referring to FIG. 6, first of all, the control unit 80 is explained. The control unit 80 comprises a group of control registers 802, a controller 804, a register-number register 806, a controller 808, a selector 810, a decoder 812, NAND gates 814, and an access controller 816.

The group of control registers 802 is formed by seven 4-bit registers. These registers 802 are supplied with the signal CDATA from the image processer 2 under control of the controller 804, and initialized by the signal RESET. The function and operation of main ones of these registers 802 are as follows.

(1) WMOD register (register No. 0)

This register designates the mode of the write operation to the image memory 4 which has been already referred to. The relation between the content of this register (called value of WMOD hereinafter) and the mode of the write operation is as follows:

| Value of WMOD | Mode of Write Operation |
|---|---|
| 0 | single mode |
| 1 | block mode |
| 2 | copy mode |

(2) MFUN register (register No. 1)

This register designates the mode of the modification in the write data processing unit 84. The mode of modification between two signals, e.g. f and g, is determined as follows in accordance with the content of this register (called a value of MFUN hereinafter):

| Value of MFUN | Mode of Modification |
|---|---|
| 0 | f (no modification) |
| 1 | f AND g |
| 2 | f OR g |
| 3 | f Exclusive OR g |
| 4 | f Exclusive NOR g |
| 5 | g (no modification) |
| 6 | NOT f |
| 7 | NOT g |
| 8 | f + g |
| 9 | max (f, g) |
| 10 | min (f, g) |

(3) CN/DN register (register No. 2)

Figure 4:
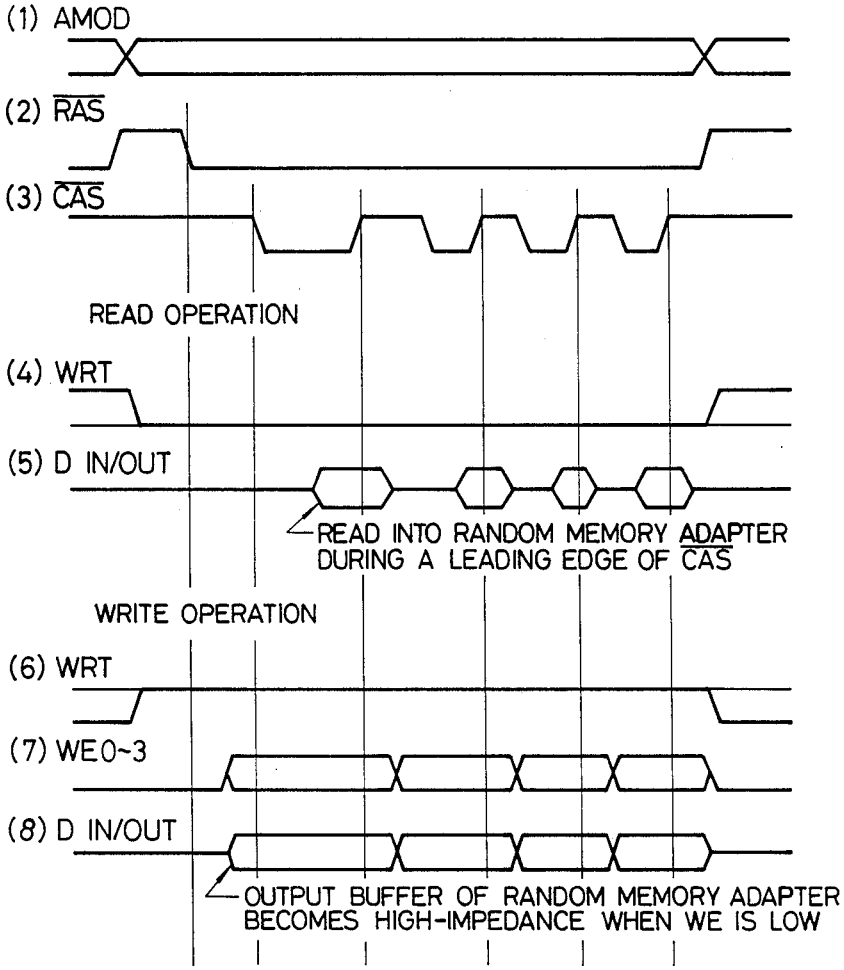
FIG. 4 is a time chart for the purpose of explaining the read/write operation of the dynamic random access memory shown in FIG. 2.

The CN/DN register is one that designates the access mode in the copy and display operations. This register can take a value from "1" to "4" as its content. The value is called a CN/DN value hereinafter. When the CN/DN value is "1", the access is of ordinary mode. This value must be set at "1", when at static-type RAM is used. When the CN/DN value is other than "1", the access is of either one of the page and nibble modes and a repetition cycle within one access is determined by the value thereof. The CN/DN value is necessary for a barrel shift in the copy and display processings. Though this can be automatically detected and controlled by the strobe signals $\overline{RAS}$ and $\overline{CAS}$, as shown in FIG. 4, it is set from outside in this embodiment for the purpose of simplification.

The remaining registers, i.e., DSFT, VSFT, FSFT and CSFT registers which have the register Nos. 3, 4, 5 and 6, respectively, designate the number of shift stages in the display, feedback data input, feedback write and copy processings, respectively, which will be referred to more in detail with reference to the data processing to which these registers relate. The group of these control registers 802 is controlled by the controller 804, which receives the signals $\overline{STB}$ and the RS/$\overline{DS}$ and controls whether to set the signal CDATA of four bits to the register-number register 806 or to one of the control registers 802 designated by the register-number register 806. Namely, when the signal RS/$\overline{DS}$ is "0", the register number indicated by the signal CDATA is set to the register-number register 806 in synchronism with the signal $\overline{STB}$. When the signal RS/$\overline{DS}$ is "1", the signal CDATA is set into one of the control registers 802 designated by the content of the register-number register 806. The information of the control registers 802 is sent to the necessary portions of RMA 8 through an internal control bus CB1.

A control of the write enable signals WE 0 to 3 is made in the following manner. The controller 808 receives the signals AMOD and WMOD and makes the selector 810 select one of three input signals in accordance with combination of the value of the signals AMOD and WMOD. The three input signals of the selector 810 are the signal BADR decoded by the decoder 812, a feedback data write enable signal FDEN sent through the write data bus 102 and the signal CDATA. The selected signal is produced as the signal WE 0 to 3 from the selector 810. The condition of selection is as follows.

(a) AMOD=0 and WMOD is not cared about

In this case, the operation is the feedback-write operation, and the signals FDEN sent from the feedback data processing unit 86 is selected.

(b) AMOD=1 and WMOD=0

The operation is the single mode access from the image processer 2. In this case, the signal BADR is decoded by the decoder 812 and selected by the selector 810. Accordingly, the data is permitted to be written for only one pixel.

(c) AMOD=1 and WMOD=1 or 2

The operation is the block-mode or copy-mode write operation, and the signal CDATA is selected. Therefore, it can be arbitrarily designated by the image processer 2 which pixels are to be written. The signal CDATA may be controlled in accordance with the time chart of FIG. 4 at the time of the page and nibble mode access.

In order to control the buses MDATA 0 to 3 connecting between DRAM blocks 60 to 63 and MRA 8, control signals CW 0 to 3 are provided by four 2-input NAND gates 814 (only two gates are indicated in the drawing) and carried to the output buffers 920 to 923 through a line CW. One input signal of each of NAND gates 814 is the signal WRT sent from the image processer 2 through the access controller 816 and the other input is one of the signals WE 0 to 3. It is noted that the signals WE 0 to 3 correspond to the signals CW 0 to 3, respectively. Accordingly, only the output buffer 920, 921, 922 or 923 which relates to DRAM block 60, 61, 62 or 63 selected by the signal WE 0, 1, 2 or 3 can pass the data to the selected DRAM block through MDATA 0, 1, 2 or 3.

For the purpose of other controls, the access controller 816 produces the following signals in accordance with the signals AMOD, $\overline{RAS}$, $\overline{CAS}$, WRT and CDATA.

(1) MRSTB

A strobe signal which is produced by the leading edge of $\overline{CAS}$ under the condition of AMOD="1", WRT="0" and CDATA="1" and sets the read data into a modification register of the write data processing unit 84;

(2) CRSTB

A strobe signal which is produced by the leading edge of $\overline{CAS}$ under the condition of AMOD="1", WRT="0" and CDATA="2" and sets the read data into copy registers of the write data processing unit 84;

(3) DSTB

A strobe signal which is produced by the leading edge of $\overline{CAS}$ under the condition of AMOD="0" and WRT="0" and sets the read data into a display data register in the display data processing unit 88;

(4) FSTB

A strobe signal for a feedback write shift register in the feedback data processing unit 86, which is produced by the leading edge of $\overline{CAS}$ under the condition of AMOD="0" and WRT="1";

(5) FWDSEL

A signal for selecting data to be written into the feedback write shift register, which is set by FSTB above and reset by the trailing edge of $\overline{RAS}$; and (6) IPREN A signal which is produced under the condition of AMOD="1", WRT="0" and $\overline{CAS}$=0" and outputs the data from the read data processing unit 82 as the data IDATA to the image processer 2.

These signals are transmitted to the necessary portion in RMA 8 through an internal control bus CB 2.

Figure 7:
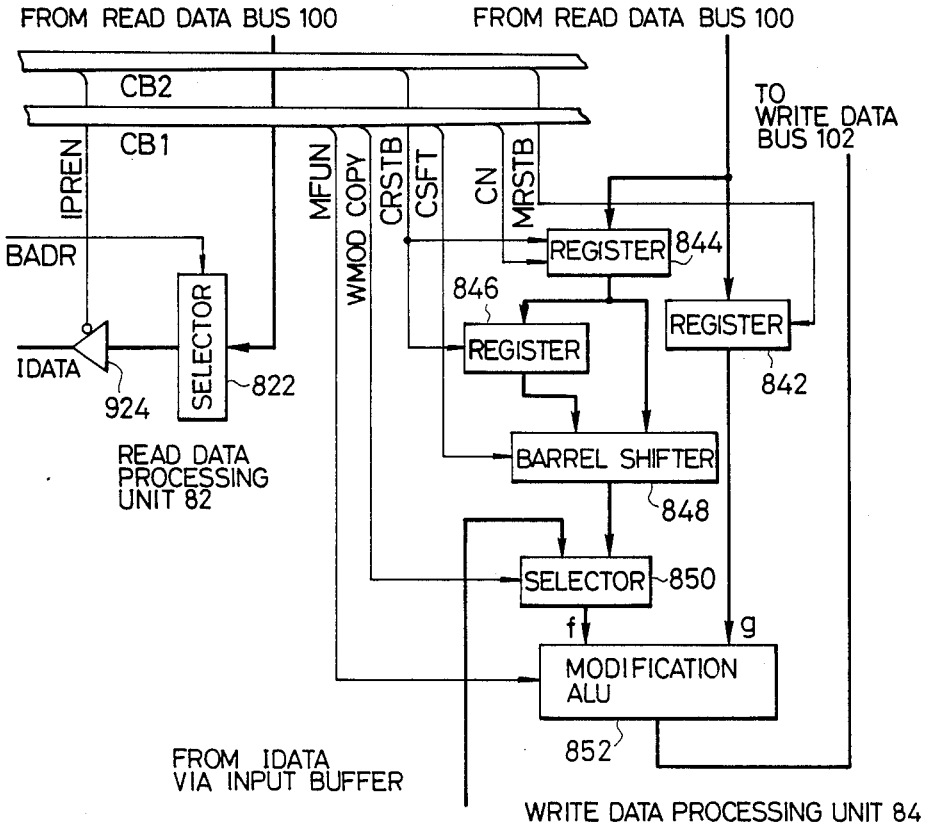
FIG. 7 is a block diagram showing a read data processing unit and a write data processing unit of the peripheral apparatus shown in FIG. 3.

3.4 Read and Write Data Processing Units 82 and 84:

As shown in FIG. 7, the read data processing unit 82 selects and produces the data for one pixel designated by the signal BADR among the data for four pixels on the read data bus 100 by means of a selector 822. This output data is sent out to the bus IDATA through the output buffer 924, which is controlled by the signal IPREN signal.

The write data processing unit 84 consists of a read data register 842 for modification (modification register), read data registers 844, 846 for copy (copy register), a barrel shifter 848, a selector 850 and a modification arithmetic logic unit (modification ALU) 852.

The data read out onto the read data bus 100 is taken into the modification register 842 by the signal MRSTB. The modification ALU 852 calculates the data g from the modification register 842 and the output data f of the selector 850 in accordance with the instruction of the signal MFUN, and produces the result to the write data bus 102, when the signal AMOD is "1".

When the write operation is not in the copy mode, i.e., WMOD is "0" or "1", the selector 850 selects the signal IDATA. In the copy mode, however, the selector 850 selects the shift result of the content of the copy registers 844, 846 which is shifted by the barrel shifter 848 in accordance with the signal CSFT. The copy registers 844 and 846 are triggered by the signal CRSTB and, as shown in FIG. 5c, have to hold the read data for the two operations. For this purpose, two registers are provided so that the newly read-out data is set to the register 844 and the old data read out at the previous time is transferred to the register 846. The barrel shifter 848 shifts these two read-out data by the arbitrary amount of pixels and, as shown in FIG. 5c, selects the data for four pixels to send them to the selector 850. The page or nibble mode access operation here is controlled by the signal CN, but since this control is the same as the control in the display processing unit 88, its detailed description is omitted here.

Figure 8:
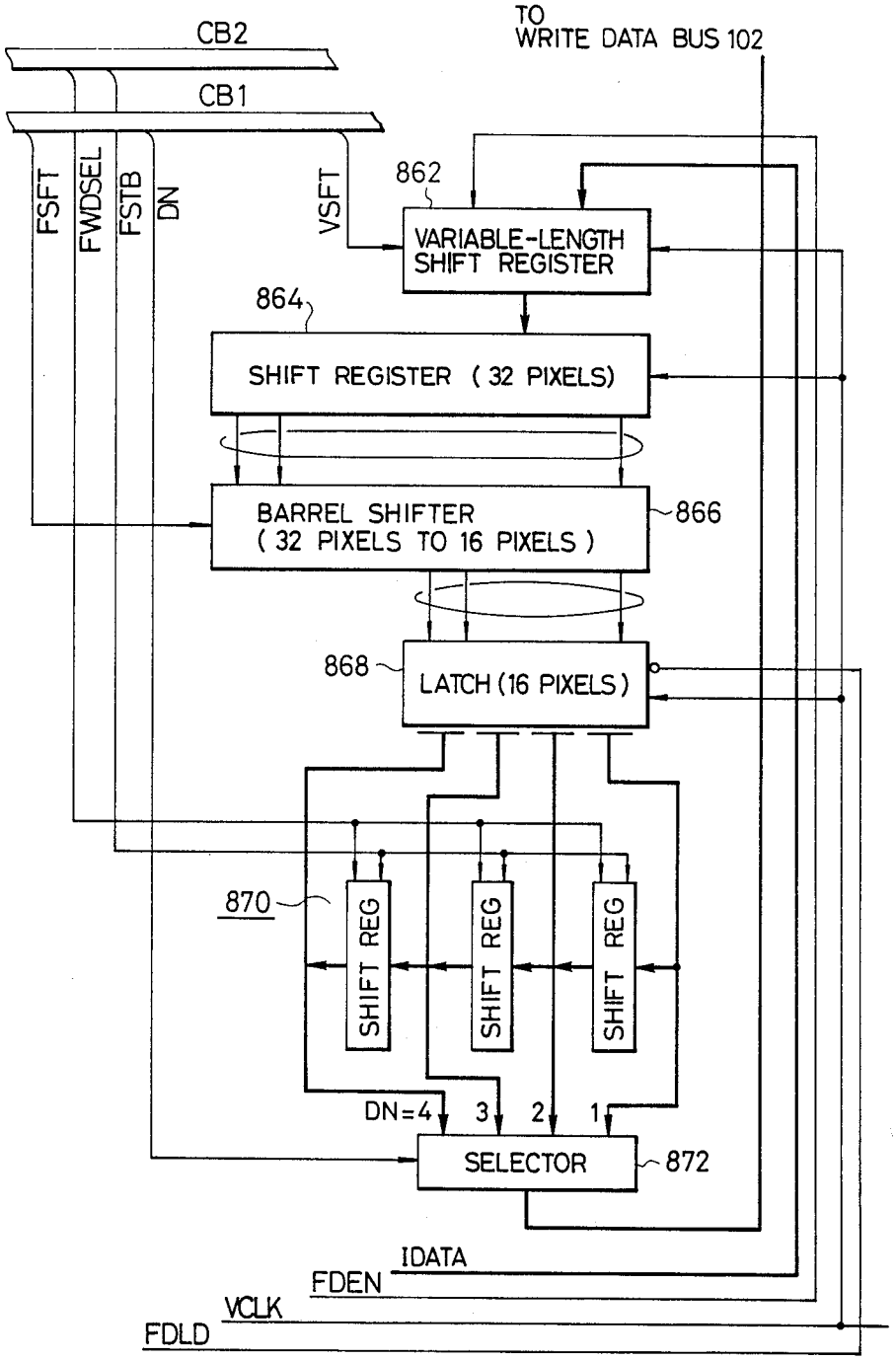
FIG. 8 is a block diagram of a feedback data processing unit of the peripheral apparatus shown in FIG. 3.

3.5 Feedback Data Processing Unit 86:

Referring to FIG. 8, the feedback data processing unit 86 consists of a variable-length shift register 862, a shift register 864, a barrel shifter 866, a latch 868, a feedback-data-write shift register 870 composed of three shift registers and a selector 872.

The signal IDATA and the feedback data effective signal FDEN are once applied to the variable-length shift register 862. The length of this register 862 is designated by the signal VSFT, and can be used for compensation of delay of the processing in the image processer 2.

The output of this variable-length shift register 862 is transferred to the shift register 864 which has a capacity of 32 pixels, that is, 4 pixels×4 times of page or nibble mode read-out operations×2 sets. Among them, the data for arbitrary 16 pixels is segmented by the barrel shifter 866 and set to the latch 868 by an external load signal FDLD. Further, the shift register 862, 864 and the latch 868 are operated by a video clock signal VCLK and the amount of shift in the barrel shifter 866 is determined by the signal FSFT.

The data loaded to the latch 868 is transferred to the feedback-data-write shift register 870 by the "ON" state of both the signals FWDSEL and FSTB and the transferred data is shifted in the shift registers 870 by the signal during the "OFF" state of the signal FWDSEL. In other words, as shown in the time chart of FIG. 4, the data of the latch 868 is produced as the write data to be set into the shift registers 870 in the first period of the signal $\overline{CAS}$ and the data set to the shift registers 870 is shifted one after another and produced in the subsequent periods of the signal $\overline{CAS}$.

The selector 872 selects the repetition number of the page or nibble mode operation in accordance with the value of the signal DN. That is to say, when DN=4, the data for the four pixels at the left end of the selector 872 is always produced to the write data bus 102 and eventually, the data for every four pixels from the left end of the latch 868 are produced four times. Similarly, when DN=3, the data for every four pixels from the fifth pixel on the left side are produced thrice. When DN=2, the data for every four pixels are produced twice from the ninth pixel on the left side, and when DN=1, the data for only four pixels on the right end of the selector 872 are produced once. In any of these cases, therefore, the data for only one write-in region may be segmented by the signal FSFT in the barrel shifter 866 and may be set to the latch 868, when the data of the write pixels for two times are input to the shift register 864 and shifted therein in the right-justified arrangement. This will be explained once again with reference to FIG. 11

Figure 9:
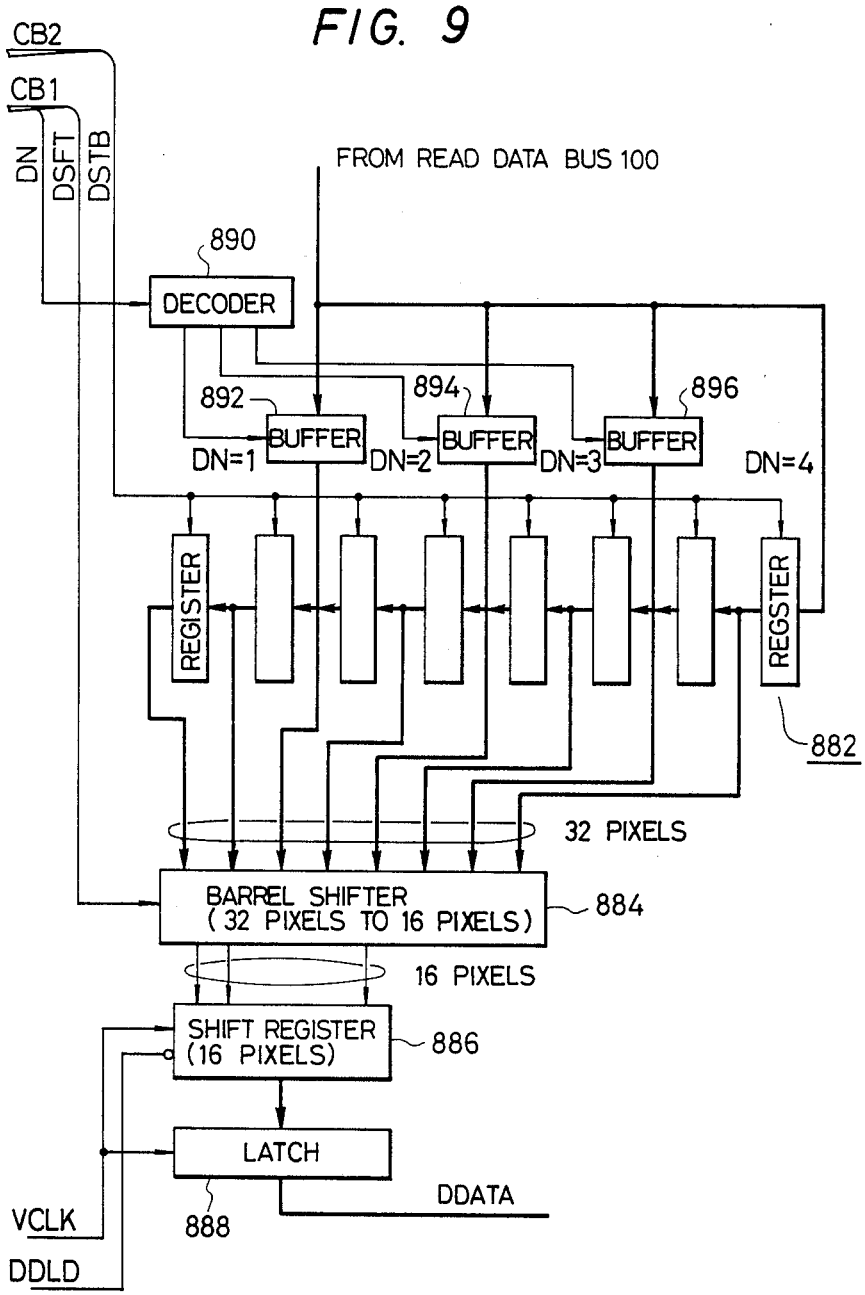
FIG. 9 is a block diagram of a display data processing unit of the peripheral apparatus shown in FIG. 3.

3.6 Display Data Processing Unit 88:

Referring to FIG. 9, the display data processing unit 88 has a display-data-read shift register 882 composed of eight shift registers, a barrel shifter 884, a shift register 886, a latch 888, a decoder 890 and three buffers 892 to 894.

The data corresponding to the four pixels read out onto the read data bus 100 are taken into one of the eight shift registers 882 designated by the signal DN at the timing of the signal DSTB, each of the shift registers being capable of storing the data for four pixels. The data of maximum 32 pixels that are read out in this manner for the purpose of display are shifted by the barrel shifter 884 in accordance with the value designated by the signal DSFT, and are set to the shift register 886 by the external load signal DDLD. The data of the shift register 886 is shifted by the video clock VCLK, and the result is produced as the display data DDATA through the latch 888.

Figure 10:
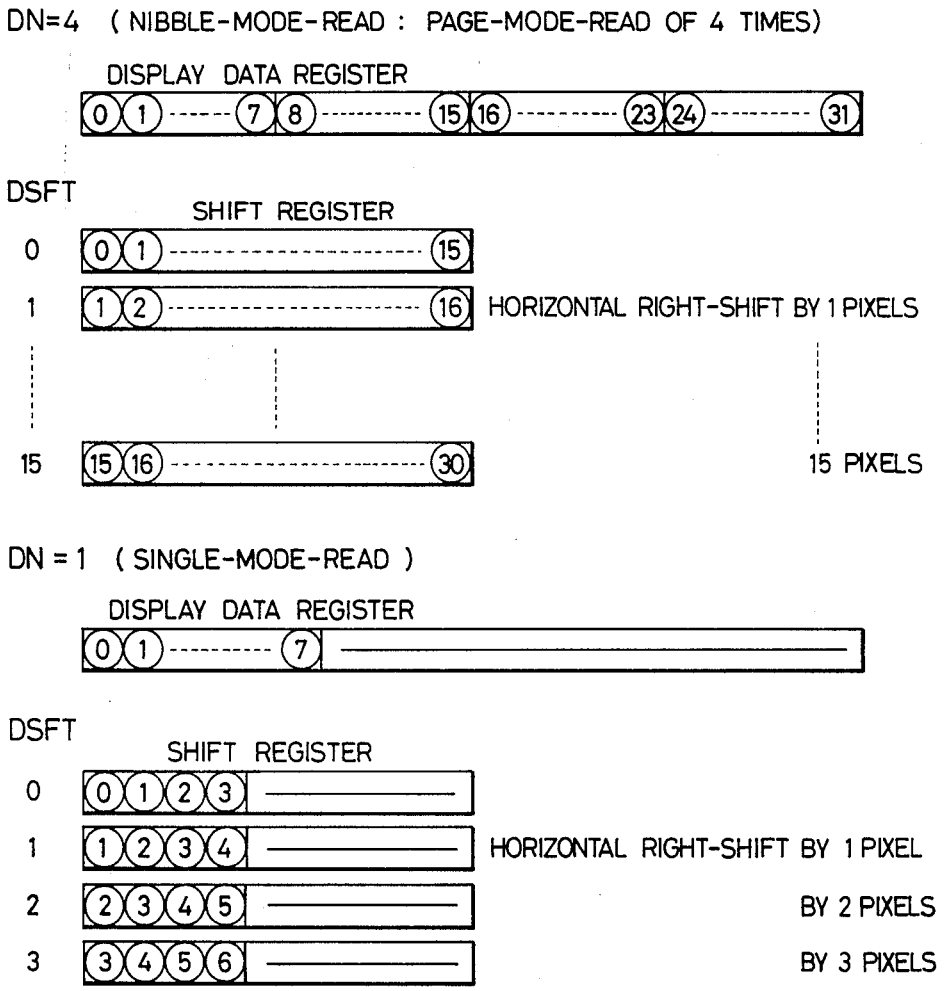
FIG. 10 is a schematic view for the purpose of explaining the shift operation in the display data processing unit shown in FIG. 9.

The output processing of the read data will be explained with reference to FIG. 10. When DN=4, for example, the data for 32 pixels are set to the registers 882 by two access operations, and the data that are deviated toward the right by the number of pixels corresponding to the value of 0 to 15 of the signal DSFT are set to the shift register 886. When DN=1, the data for eight pixels corresponding to two access operations are set in the left-justified arrangement to the display-data-read register 882, and the data that are deviated toward the right by the number of pixels in accordance with the value 0 to 3 of the signal DSFT are set to the shift register 886. In this manner, the transverse scroll of a display screen can be realized smoothly by the signal DSFT.

4. Operation and Others

Hereinbefore, each unit forming the RMA 8 has been explained in detail. Next, referring to FIG. 11, the description will be made of an example of the operation that the display data is fed back to be processed and is written into the image memory 4 again.

Figure 11A:
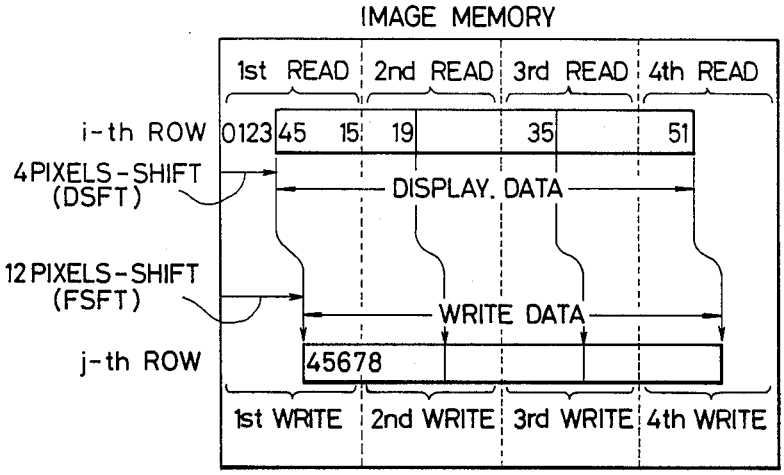
FIG. 11*a* is a schematic illustration for the purpose of explaining the feedback-write operation to the image memory by means of the feedback data processing unit shown in FIG. 8
Figure 11B:
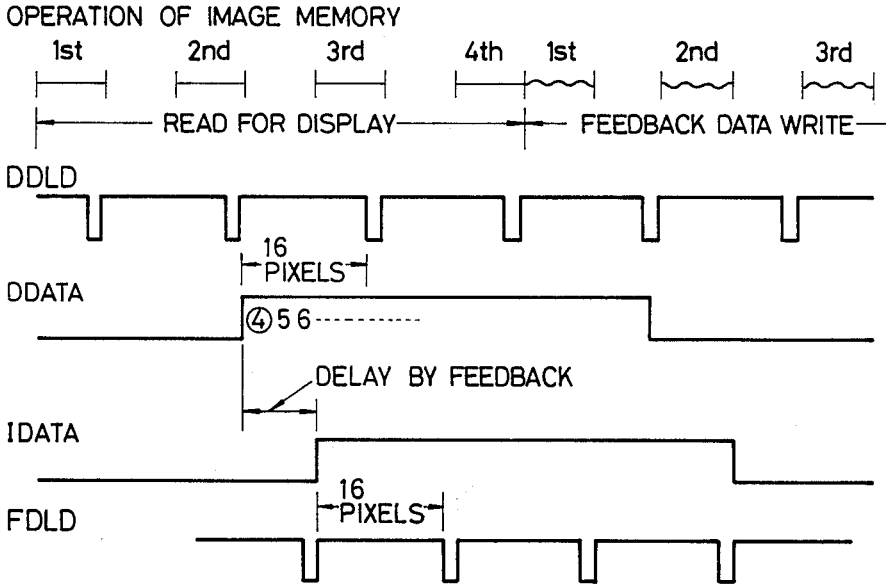
FIG. 11*b* is a time chart showing the change of the various signals with respect to time in the display and feedback data processing operations.

FIG. 11*a* assumes the display and feedback processing at the time of the nibble mode of DN=4. Namely, 48 pixels from the fourth pixel of the i-th row are read out and the processed result is written from the 12th pixel of the j-th row, by way of example. FIG. 11*b* shows the time chart of this operation. After the read operation is effected twice for display, the four-pixel shift is conducted toward the right (DSFT=4) and the shifted data is produced as the display data. After the image processer 2 processes this result, the data is applied from the bus IDATA to RMA 8. After the feedback data processing unit 86 takes the data corresponding to the 16 pixels thereinto, the data is shifted toward the right by 12 pixels corresponding to the region of the first write operation (FSFT=12) and are segmented. It is written at the next timing of the write operation, and this operation is repeated four times. Portions unnecessary for the first and final write operations are controlled by the feedback data effective signal FDEN. The signal VSFT is utilized in order to synchronize the timing of the load of the feedback data with that of the write operation to the image memory 4.

The function and operation of the image memory peripheral LSI, i.e., raster memory adapter (RMA) has thus been described with respect to the case where the number of pixels read out in parallel is four (n=4), the maximum repetition number of the page or nibble mode operation is also 4 (m=4), and one pixel has four bits.

The reason why n=4 in this embodiment, as mentioned above, is as follows. Namely the formation speed of the image data of an ordinary television camera is 12 mega pixels/sec. On the other hand, when the aforementioned DRAM is operated in the nibble mode (repeated four times), the time required is about 500 n sec, and therefore the processing of 16 pixels can be made in 1 μsec, that is, 16 mega pixels/sec, when display (feedback) is made on the time-sharing basis.

The reason why 4 bits/pixel is used is that the technology of gray-scaled and colored image has progressed in recent years and hence, the bit number should be increased to be within the range permitted by the number of pins, though the minimum density information is 1 bit/pixel. If 8 bit/pixel is used, the number of pins of the peripheral LSI chip exceeds 64, and if 4 bit/pixel is used, the pin number is below 48. On the other hand, even if 2 bit/pixel is used, the pin number is about 40. Therefore, four pixel parallel, 4 bit/pixel is the most optimal as described above.

Although RMA has been described as a definite example of the image memory peripheral LSI, the following variations are considered with respect to the present invention.

(1) When only the graphics function is required, the feedback data processing unit 86 is deleted and, further in a specific case, the copy function of the write data processing unit 84 can be also deleted.

(2) Two of the display data processing units 88 may be disposed so that they are used for the overlap display or be used independently for display and for feedback processing, respectively.

(3) By inputting the feedback data signal IDATA processed in the image processer 2 into the display data processing unit 88 and switching the signal IDATA and the data read out from DRAM, the monitor 10 can display both data selectively.

As to the expansibility of the present embodiment, the following expansion can be made.

(1) Increase of the number of bits per pixel:
This can be accomplished by merely increasing the number of pairs of DRAM and RMA.

(2) Promotion of display data speed:
The speed is 16 mega pixels/sec by one RAM (twice, if used exclusively for display). The display data speed can be made double by allotting odd-numbered pixels to one RMA and even-numbered pixels to the other RMA and by externally serializing the outputs from these two RMAs. In this manner, a plurality of RMAs disposed in parallel becomes possible to promote the display data speed.

5. Effects of the Invention

In accordance with the present invention, an image memory having a large number of functions and high performance can be realized by use of the standard-type DRAM.

(1) DRAM can be operated in the nibble or page mode, and the performance can be doubled when compared with ordinary access.

(2) Feedback processing necessary for the image processing system which processes the image data now on displaying and writes the processed data into the image memory again, can be made.

(3) Modification write operation between the data that has already been written in the image memory and the data that is to be written afresh can be made.

(4) Block write operation for writing plural pixels in parallel is possible, and thereby, the performance can be improved.

(5) Feedback processing and copy processing for an arbitrary region can be made.

(6) The smooth scroll of the display screen is possible.

We claim:

1. A peripheral apparatus for image memories which includes an image memory for an image processing system together with a memory assembly composed of plural random access memory blocks (RAM blocks) such that n of said plural random access memory blocks, wherein n is an integer greater than or equal to 2, are available for accessing in parallel, and with the image memory being connected with an external image processor and a display monitor to communicate processed data or display data therewith under control of the peripheral apparatus, comprising:

a read data processing unit comprising a selector which receives image data of n pixels read out from said n RAM blocks in parallel, selects the image data of one of said n pixels designated by a block address signal given from said external processor, and transmits the selected data to said external processor;

a write data processing unit receiving the processed data from said external processor, modifying the received data in accordance with a modification function signal, and writing the modified data into said n RAM blocks in the form of n parallel pixels or in a single pixel in response to a control data given from said external processor;

a display data processing unit comprising a display shift register, which stores the image data read out from said n RAM blocks during the read operation for display, and outputs the image data stored therein as a display data for each pixel in response to a video clock of the display monitor, the storing capacity of said display shift register being equal to $n \times m$ pixels, wherein m is an integer equal to or greater than 2, which represents the maximal number of repetition times of access per one memory cycle, and the amount of the image data actually stored therein being dependent upon an access mode signal indicative of the number of repetition times of access per one memory cycle; and a control unit which provides control signals to each of said processing units including the modification function signal and the access mode signal in response to instructions from said external processor and for controlling the write operation by accessing said memory assembly.

2. A peripheral apparatus for image memories according to claim 1, wherein said memory assembly is organized such that said n RAM blocks operate in a page mode.

3. A peripheral apparatus for image memories according to claim 1, wherein said memory assembly is organized such that said n RAM blocks operate in a nibble mode.

4. A periperal apparatus for image memories according to claim 1, wherein said display data processing unit further comprises a display-data-read shift register having a storing capacity for the image data corresponding to $2 \times n \times m$ pixels and storing said image data corresponding to the sum of the number of pixels of the image data that have already been read out for display and that of the image data to be newly read out during the read operation for display, a display barrel shifter for segmenting arbitrary $n \times m$ pixels from said display-data-read shift register, and said display shift register taking the image data from said barrel shifter and outputting the image data for display for each pixel.

5. A peripheral apparatus for image memories according to claim 1, wherein said write data processing unit includes a copy register holding the image data of n×m pixels read out for copy from said n RAM blocks and the image data held in said copy register is written into said memory assembly in the form corresponding to the image data of n pixels on a time-sharing basis of m times.

6. A peripheral apparatus for image memories according to claim 5, wherein said copy register consists of two registers each of which is capable of holding the image data of n×m pixels, one of them holding the image data that has already been read out for copy and the other the image data that is to be read out and said write data processing unit further comprises a barrel shifter which segments arbitrary n×m pixels from the contents of said two registers.

7. A peripheral apparatus for image memories according to claim 5, wherein said write data processing unit further comprises a modification register holding the image data corresponding to n×m pixels read out from said n RAM blocks and an arithmetic logic unit which executes an arithmetic or logic operation between the contents of said copy register and said modification register in response to the modification function signal and writes the operational result into said memory assembly in the form of the image data of n pixels on the time-sharing basis of m times.

8. A peripheral apparatus for image memories according to claim 1, wherein said write data processing unit comprises a modification register holding the image data of n×m pixels read out from said n RAM blocks and a modification arithmetic logic unit which executes an arithmetic or logic operation between the image data from said external processor and the content of said modification register in response to the modification function signal and writes the operational result into said memory assembly in the form of the image data of n pixels on the time-sharing basis of m times.

9. A peripheral apparatus for image memories according to claim 8, wherein said write data processing unit has a copy register holding the image data of n×m pixels read out for copy from said n RAM blocks and a selector for selecting either one of the content of said copy register or the image data from said external processor, and wherein said modification arithmetic logic unit executes the arithmetic or logic operation between the output from said selector and the content of said modification register.

10. A peripheral apparatus for image memories according to claim 1, wherein there is further provided a feedback data processing unit which comprises a shift register for storing the data received from said external processor as a result of processing of the image data now being displayed, a latch for holding the image data of n×m pixels from among the data stored in said shift register and a selector which selects the amount of the image data designated by the access mode signal from said control unit from the image data held in said latch and writes the selected image data into said memory assembly in the form of the image data of n pixels on a time-sharing basis of m times.

11. A peripheral apparatus for image memories according to claim 10, wherein said shift register corresponding to said feedback data processing unit is capable of storing the image data of 2×n×m pixels and there is further provided a barrel shifter which segments the image data of n×m pixels from the content of said shift register and supplies the segmented image data for said latch.

12. An image memory for an image processing system including an external image processor and a display monitor comprising:

a memory assembly including a plurality of random access memory blocks (RAM blocks) capable of accessing in parallel n blocks thereof, wherein n is an integer equal to or greater than 2;

a read data processing unit including means for receiving image data of n pixels read out from the n RAM blocks in parallel, selecting the image data of one of the n pixels designated by a block address signal given from said external processor, and sending out the selected image data to said external processor;

a write data processing unit including means for receiving a processed data from said external processor, modifying the received data in accordance with a modification function signal, and writing the modified data into said memory assembly;

a display data processing unit including means for holding the image data, the amount of which corresponds to the image data read out during at least two access time of said memory assembly within one memory cycle, wherein the number of access times of said memory assembly per one memory cycle is determined by an access mode signal, and outputting display data corresponding to each of the pixels stored therein in response to a video clock of the display monitor; and a control unit for providing control signals including the modification function signal and the access mode signal in response to instructions from said external processor and for controlling the access to said memory assembly.

13. An image memory according to claim 12, wherein said display data processing unit comprises a display-data-read shift register having a storing capacity for the image data corresponding to 2×n×m pixels and storing said image data corresponding to the sum of the number of pixels of the image data that have been already read out for display and that of the image data to be newly read out during the read operation for display, a display barrel shifter for segmenting arbitrary n×m pixels from said display-data-read shift register, and a display shift register taking the image data from said barrel shifter and outputting the image data for display for each pixel, wherein m is an integer equal to at least 2 and which represents the maximal number of repetition times of access per one memory cycle.

14. An image memory according to claim 12, wherein said write data processing unit includes a copy register holding the image data of n×m pixels read out for copy from said n RAM blocks and the image data held in said copy register is written into said memory assembly in the form of the image data corresponding to n pixels on a time-sharing basis of m times wherein m is an integer equal to at least 2 and which represents the maximal number of repetition times of access per one memory cycle.

15. An image memory according to claim 14, wherein said copy register consists of two registers each of which is capable of holding the image data of n×m pixels, one of them holding the image data that has already been read out for copy and the other image data that is to be read out and said write data processing unit further comprises a barrel shifter which segments arbitrary n×m pixels from the contents of said two registers.

16. An image memory according to claim 14, wherein said write data processing unit further comprises a modification register holding the image data corresponding to n×m pixels read out from said n RAM blocks and an arithmetic logic unit which executes an arithmetic or logic operation between the contents of said copy register and said modification register in response to the modification function signal and writes the operational result into said memory assembly in the form of the image data of n pixels on the time-sharing basis of m times.

17. An image memory according to claim 12, wherein said write data processing unit comprises a modification register holding the image data of n×m pixels read out from said n RAM blocks and a modification arithmetic logic unit which executes an arithmetic or logic operation between the image data from said external processor and the content of said modification register in response to the modification function signal and writes the operational result into said memory assembly in the form of the image data of n pixels on the time-sharing basis of m times, wherein m is an integer equal to at least 2 and which represents the maximal number of repetition times of access per one memory cycle.

18. An image memory according to claim 17, wherein said write data processing unit has a copy register holding the image data of n×m pixels read out for copy from said n RAM blocks and a selector for selecting either one of the content of said copy register or the image data from said external processor, and wherein said modification arithmetic logic unit executes the arithmetic or logic operation between the output from said selector and the contents of said modification register.

19. An image memory according to claim 12, wherein there is further provided a feedback data processing unit which comprises a shift register for storing the data received from said external processor as a result of processing the image data now being displayed, a latch for holding the image data of n×m pixels from among the data stored in said shift register and a selector which selects the amount of the image data designated by the access mode signal from said control unit from the image data held in said latch and writes the selected image data into said memory assembly in the form of the image data of n pixels on a time-sharing basis of m times, wherein m is an integer equal to at least 2 and which represents the maximal number of repetition times of access per one memory cycle.

20. An image memory according to claim 19, wherein said shift register is capable of storing the image data of 2×n×m pixels and there is further provided a barrel shifter which segments the image data of n×m pixels from the content of said shift register and supplies the segmented image data for said latch.

21. An image memory for an image processing system including an external image processor and a display monitor comprising:

a memory assembly including a plurality of random access memory blocks (RAM blocks) capable of accessing in parallel n blocks thereof, wherein n is an integer equal to at least 2;

a read data processing unit means for receiving image data corresponding to n pixels read out from the n RAM blocks in parallel, selecting the image data of one of the n pixels designated by a block address signal given from said external processor, and sending out the selected image data to said external processor;

a write data processing unit comprising a copy register for storing the image data of n×m pixels read out for copy from said n RAM blocks and the image data stored in the copy register is written into said memory assembly in the form of the image data of n pixels on the time-sharing basis of m times, wherein m is an integer equal to at least 2;

a display data processing unit means for storing the image data read out from said n RAM blocks during the read operation for display and outputting the image data stored therein as a display data for each pixel in response to a video clock of the display monitor; and a control unit for providing control signals to each of said processing units in response to instructions from said external processor and for controlling the access to said memory assembly.

* * * * *